United States Patent [19]

Andersen-Vie

[11] Patent Number: 5,001,947

[45] Date of Patent: Mar. 26, 1991

[54] DUAL OPERATION RATCHET WRENCH

[75] Inventor: Axel E. Andersen-Vie, Jackson, Mich.

[73] Assignee: Jackson Assembly Enterprises, Inc., Lansing, Mich.

[21] Appl. No.: 498,541

[22] Filed: Mar. 26, 1990

[51] Int. Cl.[5] ..... B25G 1/00

[52] U.S. Cl. ..... 81/58.1; 81/177.2; 81/124.7

[58] Field of Search ..... 81/58–58.1, 81/58.4–58.5, 60, 177.1, 177.2, 177.5, 124.4, 124.7, 124.3

[56] References Cited

U.S. PATENT DOCUMENTS 1,578,065 3/1926 Bemus et al. ..... 81/177.2 X 2,247,521 7/1941 Pierce ..... 81/124.7 X 2,691,316 10/1954 Brame ..... 81/177.2 X

*Primary Examiner*—D. S. Meislin

*Attorney, Agent, or Firm*—Beaman & Beaman

[57] ABSTRACT

The invention relates to ratchet wrenches having a torque transfer member rotatably mounted on one end of a handle. The improvement comprises a pair of reinforcing plates mounted on the central portion of the handle having a polygonal shaped opening which extends through the plates and handle adapted to releasably receive one end of a socket extension. When the extension is inserted in the opening the combination of the handle and extension form a T shape whereby the ends of the handle are utilized to rotate the extension to transmit high torques for heavy duty applications which might not otherwise be possible with the ratchet torque transfer member.

3 Claims, 1 Drawing Sheet

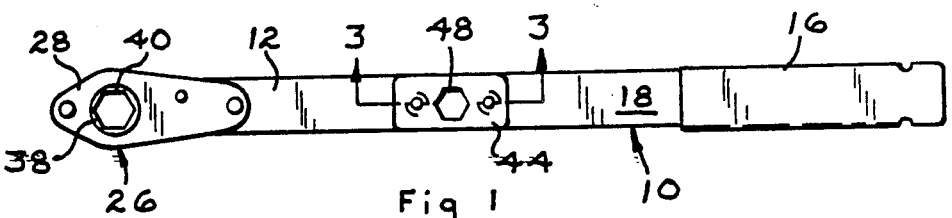
Fig 1
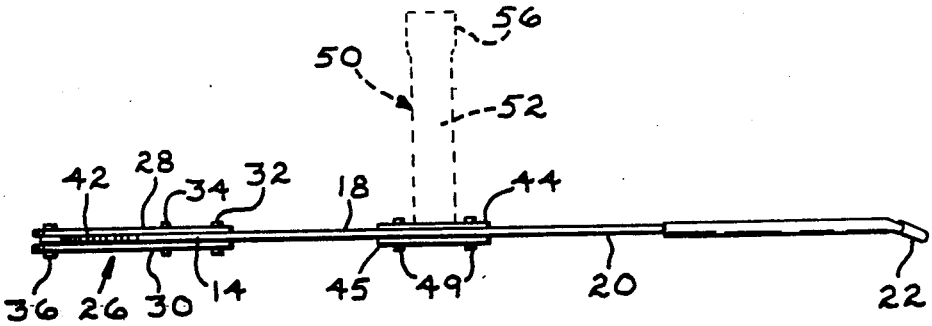
Fig 2
Fig 3
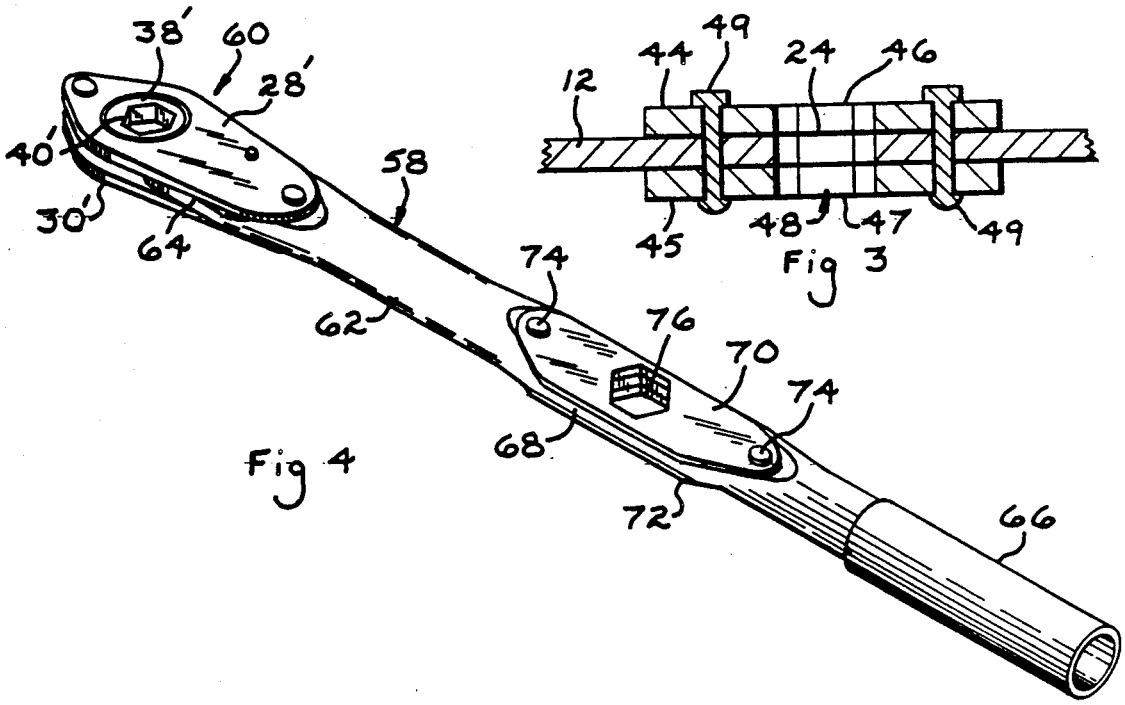
Fig 4
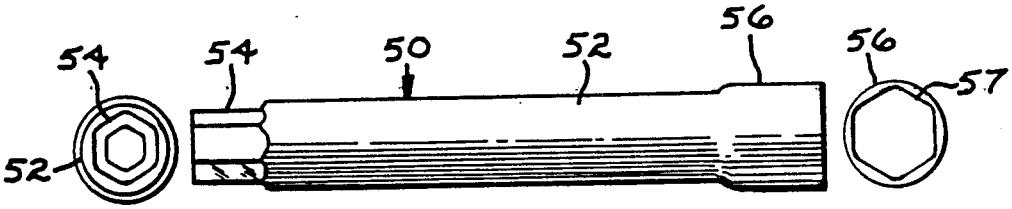
Fig 6 Fig 5 Fig 7

DUAL OPERATION RATCHET WRENCH

BACKGROUND OF THE INVENTION

Ratchet wrenches usually consist of an elongated handle upon which a ratchet head assembly is mounted adjacent one end including a rotatably supported torque transfer socket adapted to receive a member to be rotated. The handle is utilized to transmit torque to the ratchet head assembly and the member received therein. Such ratchet wrenches are easy to operate and provide a convenience for the operator in that the ratchet head assembly maintains engagement with the nut or bolt being torqued during return handle movements.

To meet cost constraints, a variety of ratchet wrenches have incorporated constructions primarily formed of stamped components and low cost materials. A typical example of an economically manufactured ratchet wrench is shown in the assignee's U.S. Pat. No. 4,913,009. Economically manufactured ratchet wrenches of this type are of relatively simple construction, easy to operate, and are dependable in operation. However, because of the dog and tooth ratchet construction ratchet wrenches are only capable of producing limited torque and cannot transmit high torques, and, consequently, ratchet wrenches are limited to relatively light duty applications.

While the ratchet head assembly is capable of transmitting limited torque, the handle itself is of relatively high strength, and if provided with an opening adapted to receive a member to be rotated, the handle could also function as a drive to directly transmit torque for heavy duty applications otherwise not possible with such wrenches. Previously, a ratchet wrench incorporating this type of dual operational handle has not been available for use.

It is an object of the invention to provide a ratchet wrench having an elongated handle and a ratchet head assembly mounted adjacent one end having a rotatably supported torque transfer socket wherein the wrench has dual operational capability in that the handle is also provided with a non-ratcheting opening for directly transmitting high torque to a torque member received therein.

Another object of the invention is to provide a ratchet wrench having dual operational capability which is primarily formed of stamped metal components including a ratchet head assembly mounted on one end of an elongated handle wherein a pair of reinforcing plates are mounted to the central portion of the handle and a socket receiving opening extends therethrough adapted to selectively receive a socket extension normal to the length of the handle, the ends of the handle being utilized to transmit high torque to the extension for heavy duty applications not otherwise possible with the wrench ratchet structure.

A further object of the invention is to provide a dual operational ratchet wrench which is of simple construction, economical to manufacture, simple to use, and dependable in operation.

In the practice of the invention an elongated handle includes a ratchet head assembly mounted at one end which includes a rotatably supported torque transfer socket adapted to receive a member to be rotated such as a bolt, nut or the like. The ratchet dog is integrally defined on the handle and the handle is utilized in the normal rachet reciprocating manner to transmit torque to the torque transfer socket and the associated fastener received therein.

In one embodiment the handle is formed of stamped sheet or plate material defining a pair of spaced sides, and a flat reinforcing plate is mounted to each side of the central portion of the handle whereby rivets extend through aligned holes in the plates and handle to complete the assembly. In another embodiment the handle is of a generally cylindrical configuration having outer ends and a flattened portion defined intermediate the ends upon which the reinforcing plates are mounted.

In both embodiments a polygonal shaped opening extends through the plates and handle having an axis normal to the length of the handle. The opening is adapted to releasably receive the complementarily shaped end of an extension having another end adapted to receive a member to be rotated. When the extension is received in the opening the combination of the handle and extension form a T shape whereby applying force to the ends of the handle in a plane normal to the opening's axis rotates the extension to transmit high torque to the fastener being rotated. If desired, the opening may be used to directly rotate a complementarily shaped nut or bolt without the use of the extension by inserting the opening thereover and rotating the ends of the handle in the same manner described.

The combination of the handle and extension permits the wrench to be used in heavy duty applications which might not otherwise be possible with the ratchet wrench structure as higher torques may be transmitted when the handle is utilized to drive a member directly than when the ratchet head assembly is utilized. Because the handle provides dual operational capability with the wrench in that the handle may be used in the normal ratchet manner or to apply torque directly to a member with the opening, a versatile ratchet wrench of simple construction and economical manufacture is maintained.

BRIEF DESCRIPTION OF THE DRAWINGS

The aforementioned objects and advantages of the invention will be appreciated from the following description and accompanying drawings wherein:

FIG. 1 is a plan view of a ratchet wrench constructed in accord with the invention, FIG. 2 is a side elevational view of the ratchet wrench of FIG. 1, a socket extension being illustrated in dotted lines, FIG. 3 is an enlarged, detail, elevational, sectional view as taken along Section 3—3 of FIG. 1, FIG. 4 is a perspective view of another embodiment of a ratchet wrench constructed in accord with the invention, FIG. 5 is an elevational view of a socket extension, per se, in accord with the invention, FIG. 6 is an end elevational view of the socket extension of FIG. 5 as taken from the left thereof, and FIG. 7 is an end elevational view of the socket extension of FIG. 5 as taken from the right thereof.

DESCRIPTION OF THE PREFERRED EMBODIMENTS

In FIGS. 1–3, a ratchet wrench incorporating the inventive concepts is illustrated as generally indicated at 10. The wrench 10 includes a handle 12 which is formed of stamped sheet or steel plate material and includes an end 14 and a grip 16 which may consist of a elastomeric covering or urethane sheath. The handle also includes sides 18 and 20, and a tang 22 defined on the handle's outer end is deflected from the plane of the handle to function as a prying tool for removing wheel covers. A hexagonal opening 24 in accord with the invention extends through the handle 12 having an axis normal to the length of the handle.

A ratchet head assembly 26, which is of the type shown in the assignee's U.S. Pat. No. 4,913,009, is pivotally mounted on the end 14. The assembly 26 includes a pair of substantially identical plates 28 and 30 which are formed by stamping, and the plates are pivotally mounted to the end 14 by a pivot rivet 32. A rivet 34 extends through both of the plates 28 and 30 and cooperates with a slot in the handle to limit the relative rotational pivoting of the head 26 upon the handle end, and a rivet 36 extends through holes formed in the outer portion of the plates to add additional strength to the assembly 26. A torque transfer socket 38 is rotatably supported between the plates 28 and 30 and includes a hexagonal shaped opening 40 adapted to receive a complementarily shaped scissors jack screw, nut, bolt or the like and establish a torque transferring relation therewith.

The end 14 of the handle 12 defines a dog detent which selectively engages ratchet teeth 42 defined on the outer periphery of the torque transfer socket 38 upon manually moving the handle in a torquing direction to lock the socket 38 relative to the head 26. Upon manually moving the handle in the opposite direction, or return direction, the detent disengages the teeth 42 to permit free rotation of the socket 38 with respect to the head 26.

A pair of substantially identical reinforcing plates 44 and 45 are stamped from sheet or plate material and include hexagonal shaped openings 46 and 47, respectively. The dimensions of the openings 46 and 47 are identical to that of the opening 24, and the plates 44 and 45 are mounted on opposite sides of the handle 12 such that the openings 46 and 47 align with the opening 24 to form the opening 48 having an axis normal to the length of the handle 12. The plates 44 and 45 are fastened to the handle 12 by rivets 49 which extend through aligned holes formed in the handle and plates, and the opening 48 is adapted to releasably receive a complementarily shaped nut, bolt, or end of a socket extension to rotate the same.

A typical socket extension adapted to be used in combination with the handle 12 is illustrated in FIGS. 5–7 generally indicated at 50. The extension 50 consists of a generally cylindrical shaft 52, which may be solid or hollow, having ends 54 and 56. The end 54 is formed into a hex shaped configuration adapted to be received in the opening 48, and, when the end 54 is inserted in the opening 48, the axis of extension 50 extends normal to the length of the handle, as indicated in the dotted lines in FIG. 2, whereby the combination of the handle 12 and extension 50 form a T. The end 56 of the extension is provided with a hexagonal shaped opening 57 adapted to receive a complementarily shaped fastener such as a bolt head or nut to be rotated.

The ratchet wrench 10 may be used to rotate a scissors jack screw, nut, bolt, or the like in the normal ratchet manner wherein the member to be rotated is received in the opening 40 and the handle 12 is moved in the necessary torquing and return directions.

To use the wrench 10 in combination with the extension 50, the end 54 is inserted in the opening 48 as illustrated in FIG. 2 and the end 56 is inserted over the fastener member to be rotated. Applying force to the outer ends of the handle 12 in a plane normal to the axis of the opening 48 rotates the extension 50 about its axis, the axis of the opening 48, in the desired direction to transmit torque to the associated member. It should be noted that the opening 48 may be utilized without the extension 50 whereby the opening 48 may directly receive a complimentarily shaped nut, bolt, or the like, and transmit a torque thereto by rotating the ends of the handle about the axis of the opening 48 in the manner described.

The combination of the handle 12 and extension 50 permits the wrench 10 to be used in heavy duty applications which might not be possible with the wrench when using the ratchet head assembly 26 alone. The dual operational ability of the wrench 10 is particularly useful in applications where a high breakaway torque is required to loosen a nut, in that the combination of the handle 12 and extension 50 may be used to initially loosen the nut and then the ratchet head assembly 26 may be applied to the nut to further loosen the nut in the normal ratchet manner.

In FIG. 4, another embodiment of a ratchet wrench in accord with the invention is disclosed generally indicated at 58 illustrating another form of a dual operational handle, and the wrench 58 employs a ratchet head assembly 60 identical to that of the ratchet head assembly 26 of the wrench 10 whereby components of the assembly 60 which are identical to that of the assembly 26 are indicated by primed reference numbers.

The handle 62 is of a generally cylindrical configuration having a flattened end 64 upon which the ratchet head 60 is mounted 19 including plates 28' and 30' which rotatably support the torque transfer member 38' having a hexagonal opening 40'. The handle 62 also includes an end 66 which may consist of an elastomeric or urethane grip, and a flattened portion 68 is defined on the handle 62 intermediate the ends 64 and 66. A pair of identical stamped plates 70 and 72 are mounted on opposite sides of the flattened portion 68 by rivets 74 which extend through aligned holes formed in the plates and handle 62. The plates 70 and 72 are each provided with hexagonal openings which align with an identical shaped opening defined in the handle 62 to form a hexagonal opening 76 having an axis normal to the length of the handle 12 and adapted to receive a socket extension, nut, bolt, or the like, in a similar manner to that of the opening 48 of the wrench 10. The wrench 58 is utilized in the same manner as the wrench 10.

The incorporation of openings in the handles of the wrenches 10 and 58 permit the wrenches to be used in heavy duty applications which might not otherwise be possible with the wrenches while the wrenches still maintain a simple and economically manufactured construction. It should be noted that the inventive concepts are not limited to the type of ratchet head assembly disclosed, and it is to be appreciated that various modifications to the invention may be apparent to those skilled in the art without departing from the spirit and scope of the invention.

I claim:

1. A ratchet wrench having a handle having a central portion having opposed sides and first and second outer ends, a torque transfer ratchet member rotatably mounted on the first outer end having means for engaging a member to be rotated, the improvement comprising said handle having a generally cylindrical configuration, a flattened portion defined on said handle central portion defining said first and second opposed sides, said flattened portion defining the central portion, an opening extending through said flattened central portion of the handle having an axis extending transverse to the length of the handle, fastening means mounting a torque transferring reinforcing plate upon at least one of said central portion's sides, said reinforcing plate having a length less than the length of the handle and comprising separate component of the handle and having a polygonal shaped opening extending therethrough and coaxially aligned with said handle's opening, said handle opening being of a polygonal configuration corresponding to and aligned with said plate opening and said plate and handle openings adapted to receive a complementarily shaped member and transmit torque thereto upon rotating the outer ends of the handle about said opening'axis.

2. In a ratchet wrench as in claim 1, wherein a reinforcing plate is mounted to each of said sides.

3. In a ratchet wrench as in claim 2, wherein said fastening means comprise rivets passing through aligned holes in said reinforcing plates and handle, each rivet passing through both of said reinforcing plates.

* * * * *